US005379462A

United States Patent [19]

Morgan et al.

[11] Patent Number: 5,379,462

[45] Date of Patent: Jan. 10, 1995

[54] MALE PANT-TYPE GARMENTS WITH INTERNAL SUSPENSORY SUPPORT STRUCTURE

[75] Inventors: Rodney A. Morgan; Kathy R. Griffin, both of Dayton, Tenn.

[73] Assignee: Robinson Manufacturing Co., Inc., Dayton, Tenn.

[21] Appl. No.: 103,971

[22] Filed: Aug. 9, 1993

[51] Int. Cl.[6] ..... A41B 9/02

[52] U.S. Cl. ..... 2/403; 2/405; 2/238; 602/70

[58] Field of Search ..... 2/403, 400, 405, 404, 2/228, 238, 234, 67; 602/67, 68, 70, 72

[56] References Cited

U.S. PATENT DOCUMENTS

| | | | |
|---|---|---|---|
| 2,033,551 | 3/1936 | Rumery | 602/73 |
| 2,601,602 | 6/1952 | Firsching, Sr. | 2/403 |
| 2,798,484 | 7/1957 | Boudreaux | 602/70 |
| 3,844,282 | 10/1974 | King | 602/67 |
| 4,378,010 | 3/1983 | McDonald | 602/70 |

*Primary Examiner*—Clifford D. Crowder
*Assistant Examiner*—Gloria Hale
*Attorney, Agent, or Firm*—McCaleb, Lucas & Brugman

[57] ABSTRACT

A male under garment, particularly male boxer type underwear shorts is disclosed having an interior liner panel suspended from the frontal waist area and central crotch zone oil the garment to provide a loose fitting, suspensory support for depending male body portions.

4 Claims, 2 Drawing Sheets

MALE PANT-TYPE GARMENTS WITH INTERNAL SUSPENSORY SUPPORT STRUCTURE

This invention relates generally to male wearing apparel and more particularly to improved structures for male garments of the short or pants types.

The prior art has developed numerous garments for male wear which have embodied interior structures capable of providing genito-support to depending male body portions. Typically these structures have been adapted to male underwear shorts, swim shorts, pajama pants, athletic shorts and like male garments. Unfortunately, such past efforts have not been favorably accepted, primarily because the support structures were unduly restrictive to the wearer's freedom of movement taking the form of complete close fitting interior briefs or more restrictive athletic supporters.

It is a primary object of this invention to provide an improved male short or pant type garment which includes an inbuilt genito-supportive structure that provides the freedom of a boxer short, with the support of a knit brief or trunk, but without the restriction of an athletic supporter to provide improved wearer comfort.

A further important object of this invention is to provide an improved garment as aforesaid that is simple and economical to manufacture.

Having described this invention, the above and further objects, features and advantages thereof will be recognized from the following detailed description of a preferred workable embodiment thereof illustrated in the accompanying drawings and representing the best mode presently contemplated for enabling those skilled in the art to practice this invention.

IN THE DRAWINGS

DESCRIPTION OF THE PREFERRED EMBODIMENT

Figure 1:
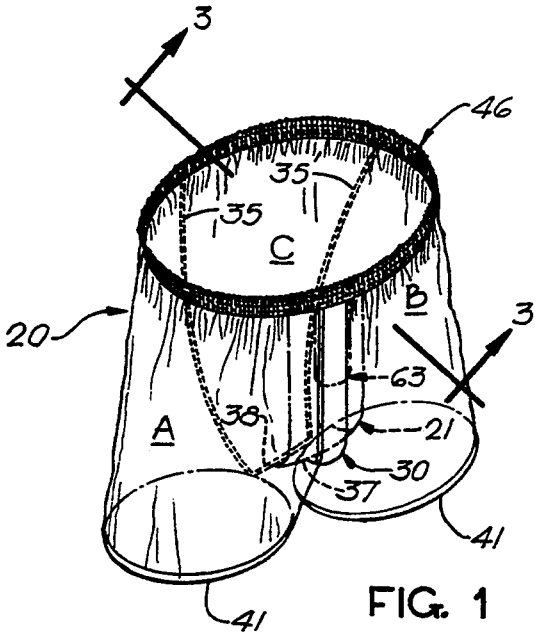
FIG. 1 is a perspective view of a male garment of this invention with the interior genito-supportive structure indicated in dotted lines therein.

Turning now to the features of a preferred embodiment of this invention illustrated in the drawings, initial reference is made to FIG. 1 from which it will be recognized that a generally conventional male undergarment, such as a boxer short 20 therein illustrated, is constructed to include an interior genito-supportive structure, generally indicated at 21.

In brief the boxer short 20 is of generally conventional make up and incorporates a pair of like frontal panels A and B (see FIG. 2) forming cooperating leg opening margins 25, 25' along their respective lower ends and waist opening margins 26, 26' along their upper ends. Panels A and B are fashioned along lateral opposing edges 27, 27' thereof with marginal cuts 28, 28' which separate fly flap areas 29, 29' respectively that are adapted to be doubled over, overlapped and stitched adjacent their upper and lower ends to provide an openable fly 30 illustrated in FIGS. 1 and 4.

Figure 3:
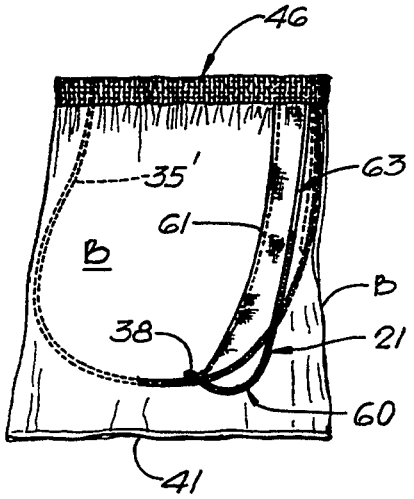
FIG. 3 is a cross sectional view taken substantially along vantage line 3—3 of FIG. 1 and looking in the direction of the arrows thereon.

A generally rectangular seat panel C is provided with parallel lateral edges 33, 33' which are hemmed to opposing lateral edges 34, 34' of the panels A and B to form rear seams 35, 35' as shown in FIGS. 1 and 3. Short bottom marginal portions 36, 36' of panel C are hemmed together forming a short seam 37 extending rearwardly from the lower end of fly 30 to intersect a transverse crotch seam 38 formed by joining a curved marginal portion 39 at the bottom of panel C to the two short marginal portions 40, 40' of the side panels A and B. It will be recognized that seam 38 extends between two leg openings formed by folding and sewing the bottom margins 25, 25' of the A and B panels to form hems 41, 41' in the garment 20 (see FIG. 1).

Figure 6:
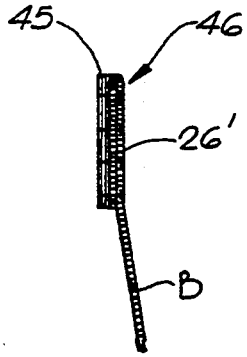
FIG. 6 is a partial enlarged, cross sectional view taken substantially along vantage line 6—6 of FIG. 4 and looking in the direction of the arrows thereon.

The upper waist margin 26, 26' of panels A and B as well as the upper end margin 43 of seat panel C are folded over and stitched to an elastic strip 45 having its ends joined together to form an annular waist band, indicated generally at 46 (see FIG. 6 and 7) according to conventional practice.

Figure 2:
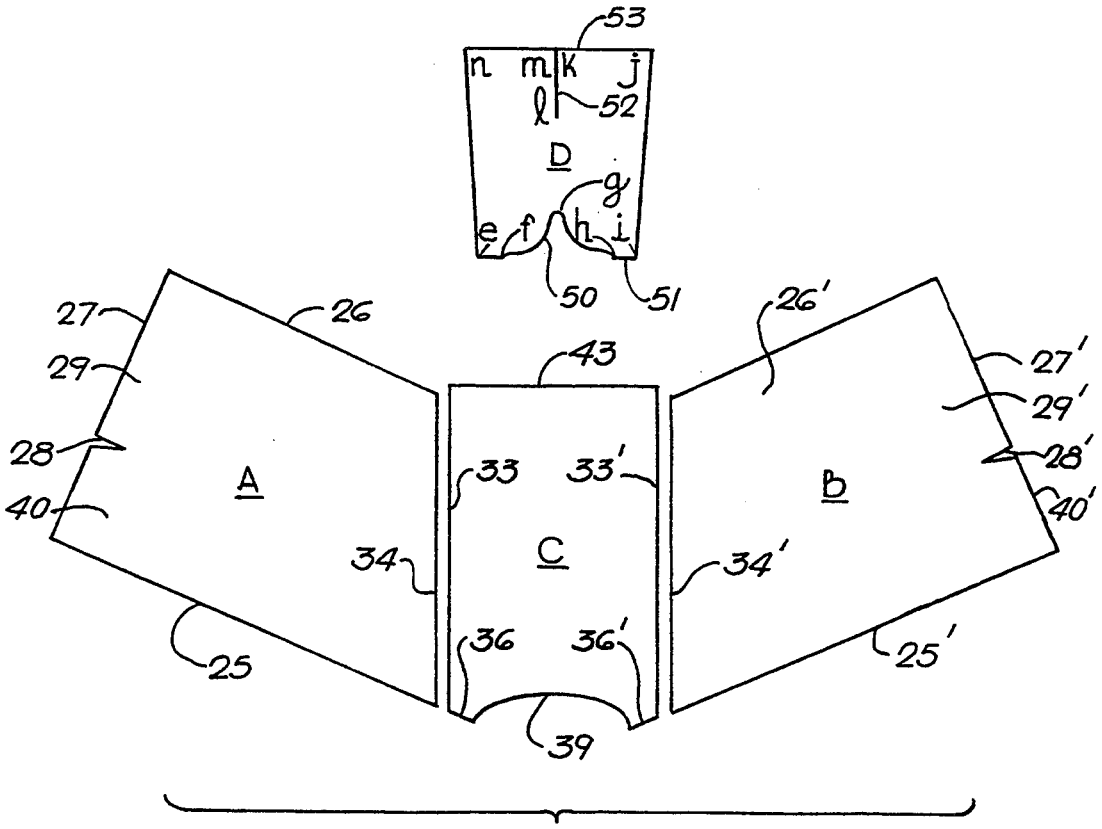
FIG. 2 is a plan layout of garment and interior supportive panels employed in the garment of FIG. 1.

With further reference to FIGS. 2 and 3, the features of the supportive structure 21, will now be described.

As best shown in FIG. 2 the supportive structure 21 comprises a generally rectangular panel D preferable of soft, moisture absorbant, open mesh, lightweight cloth. Panel D is formed with a generally V-shaped notch 50 located centrally inwardly of a lower edge 51 thereof. A linear slit 52 is also cut inwardly of the panel's upper edge 53 to extend partially along the lengthwise center line or axis of panel D between points m and 1 in alignment with notch 50.

Figure 4:
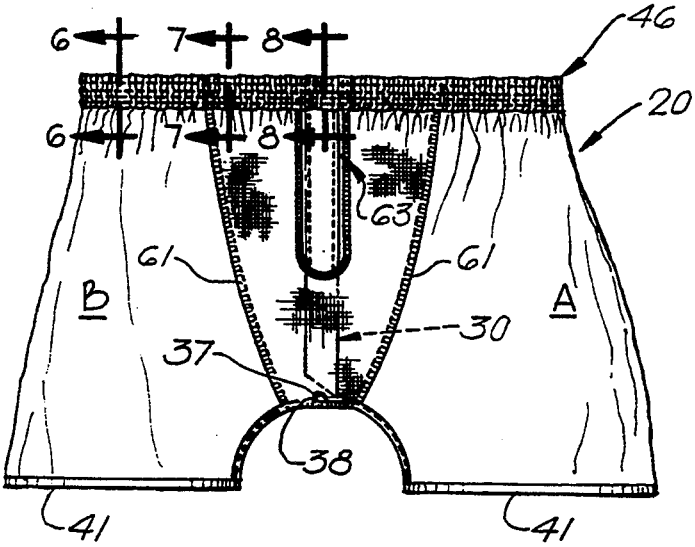
FIG. 4 is a partial rear elevational view of the garment shown in FIG. 1, looking toward the front interior thereof with the rear of the garment removed.
Figure 5:
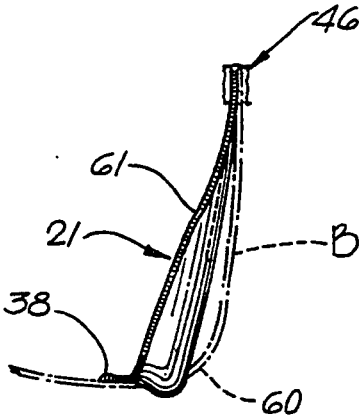
FIG. 5 is a partial side elevational view of the genito-supportive structure shown in FIG. 3 illustrative of its attachment to the garment of FIGS. 1 and 4 which is partially indicated by dotted lines therein.

To convert the planar panel D to the genito-support 21, best illustrated in FIGS. 3, 4 and 5, the panel is serged together along the V cutout edges, i.e., between points f-g-h to form a support pouch or cup indicated generally at 60. This serged seam is on the outer side of the support and therefore to the inside of the short garment in assembly to promote wearer comfort. The side margins of the panel D between points n-e and i-j are folded over to cover flat elastic bands and double stitched to form marginal hems 61, 61'. The edges of the slit 52 are also folded and serged for stability, the edges being separated to form a somewhat V-shaped comfort opening 63 located directly behind the fly 30 of the short. It will be noted that the comfort opening does not extend the full length of fly 30 (see FIG. 4).

Figure 7:
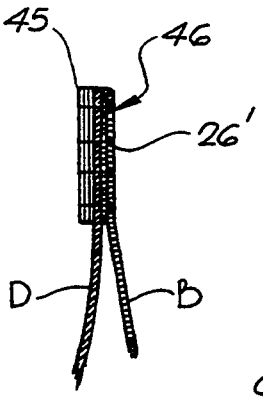
FIG. 7 is another partial, enlarged cross sectional view taken substantially along vantage line 7—7 of FIG. 4 and looking in the direction of the arrows thereon.
Figure 8:
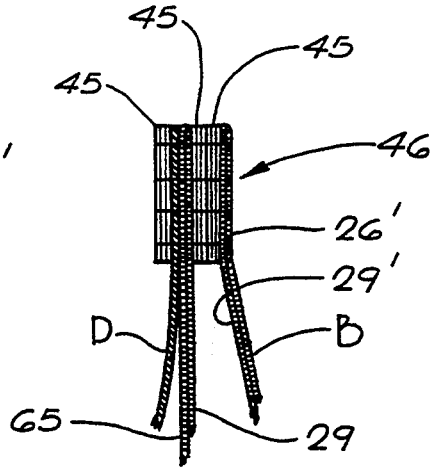
FIG. 8 is still another partial, enlarged cross-sectional view taken substantially along vantage line 8—8 of FIG. 4 and looking in the direction of the arrows thereon.

To install the support 21 in the short garment 21, the upper edge margins of panel D between points n-m and k-j are caught beneath the elastic 45 associated with the waist band as shown in FIGS. 7 and 8. It will be noted from FIG. 7, that the panel D is directly engaged with the folded over margin 29' of front panel B in that particular view and that the elastic band 45 extends over the back side of the margin 53 of support panel D between points k-j. However, as shown in FIG. 8, which is a cross section taken through the garment fly, it will be noted that the elastic 45 is doubled back behind the front fly flap 29' and that the rear fly flap 29 of panel A is covered on its inwardly oriented side with a cloth facing 65 that is engaged directly by the upper front margin of the protective support panel D between points n-m; the same being caught between the elastic 45 and facing 65.

At its opposite or operationally lower end the support member has its bottom margins between points e-f and h-i overlapped and safety seamed into the inseam 38 of the short garment and then lockstitched to provide a clean edge finish. Attachment of the lower end of the support 21 near the forward end of the garment's crotch zone adds the desired loose fitting support to the wearer without restricting flexibility and freedom of movement when wearing the garment. It will be noted that the support structure is aligned within the garment so that the pouch 60 and the comfort opening 63 thereof lie symmetrically of a vertical plane containing or passing through the central vertical axis of the fly and garment.

The mode of attaching the genito-supportive structure 21 symmetrically of fly 30 at the frontal part of the garment's waist band while attaching the lower end thereof near the forward end of the garment's crotch area, serves to provide a materially more comfortable genito-supportive structure than the prior art and permit flexibility and freedom of movement to the wearer while providing the desired supportive function according to that objective of this invention.

From the foregoing it is believed that those skilled in the art will readily recognize the novel advancement presented by this invention and will readily appreciate that although the same has been described herein as it relates to a preferred embodiment thereof, illustrated in the accompanying drawings, the same is nevertheless susceptible to modification, variation and substitution of equivalents without departing from the spirit and scope of the invention which is intended to be unlimited by the foregoing except as appears in the following appended claims.

The embodiments of the invention in which an exclusive property or privilege is claimed are defined as follows:

1. In combination with a male short or pant-type garment incorporating a waist band, a openable centrally located, vertically oriented frontal fly and a central crotch zone establishing the junction of the garment's pant legs; a genito-suspensory support comprising:

an elongated cloth liner panel formed and constructed to provide a loose fitting genito-supportive pouch open over its inner side and extending from an operationally lower end thereof, a generally V-shaped comfort opening extending from the operationally upper end of said panel partially along the central longitudinal axis thereof, and means connecting said panel to the interior of said garment so that it is aligned symmetrically behind said fly; said upper end of said panel being fastened to the garment's waist band on opposite sides of said fly and said lower end of said panel being anchored to said crotch zone; with laterally outer margins of said panel being folded over and sewn to encase elastic bands and provide covered yieldable lateral hems therealong, which hems are freely moveable and unattached to the garment between said panel's upper and lower ends.

2. The combination of claim 1, wherein said liner panel is of soft, moisture absorbant, open mesh, lightweight material.

3. The combination of claim 1, wherein said pouch is formed by joining the side margins of a substantially V-shaped opening formed inwardly of said panel's lower end; said pouch and said comfort opening being aligned symmetrically of a plane containing the central vertical axis of said garment and said frontal fly.

4. The combination of claim 3, wherein said sides of said V-shaped opening are sewn together to form an outseam centrally along the front side of said pouch which is located against the inside of the garment to promote wearer comfort.

* * * * *